US005921581A

United States Patent [19]

LaLande

[11] Patent Number: 5,921,581

[45] Date of Patent: Jul. 13, 1999

[54] MULTIPLE LAYERED CARDS ASSEMBLY AND PRODUCTION THEREOF

[75] Inventor: Jean Claude LaLande, Colchester, Vt.

[73] Assignee: Kobel, Inc., Milton, Vt.

[21] Appl. No.: 08/890,870

[22] Filed: Jul. 10, 1997

[51] Int. Cl.[6] ..... G09F 3/02; G09F 3/10

[52] U.S. Cl. ..... 283/62

[58] Field of Search ..... 283/62

[56] References Cited

U.S. PATENT DOCUMENTS 3,273,785 9/1966 Beckman et al. ..... 283/62

*Primary Examiner*—Willmon Fridie, Jr.
*Assistant Examiner*—Mark T. Henderson
*Attorney, Agent, or Firm*—Thomas N. Neiman

[57] ABSTRACT

The present invention is directed to a combined pressure sensitive and dry release structure which is a multiple layered promotion card and/or phone card. The card assembly combines a card assembly that contains information in an area that can be hidden and, at the same time, can provide a large usable area of information that is exposed to the user. Varnish is positioned in areas on the front side of the bottom sheet and silicone or other release agent is positioned on the rear side of the top sheet, and then adhesive is placed over the release agent with the balance of the adhesive positioned on the rear side of the top sheet, which provides both a dry strip card and adhesive sticking areas on the same product. In use, the card is sent to a potential client who is provided with a number of options. The rear side of the bottom sheet contains a return card to which stickers indicating specific interests are also provided on it that can be attached to the return card which is also part of the promo card. The front side of the bottom sheet contains variable image printed message, including a bar code or phone calling information positioned on the front side of the bottom sheet.

5 Claims, 5 Drawing Sheets

MULTIPLE LAYERED CARDS ASSEMBLY AND PRODUCTION THEREOF

BACKGROUND OF THE INVENTION

This invention pertains to card type devices, and in particular, to a multiple layered card assembly that is designed to allow the advertising and promotion of a product or products by using a single large postcard type unit that can have return postcards, customer preference requests, phone cards, reference cards, calendars and the like which are included in a single unit designed for the specific customer. A method of producing the multiple layered card assembly is also disclosed.

Many types and designs of advertisements and cards are currently on the market. Most current advertising mechanisms allow for a single side or double sided information panel. What is needed is a multiple layered card that will provide many sheets of information that can hide valuable information to be revealed and maintain this information within the same finished side as a single or double sided panel. What has not been done in this area is a single piece item that can be in the form of a postcard, handout or magazine insert that can contain important information like personalized numbers or return post cards, calendars and customer preferences information is contained in a single assembly designed for the specific purpose and, at the same time, can be separated into multiple items which reveals additional information. What is needed is a multiple layered cards assembly that an individual can easily and effectively print on current printing equipment while, at the same time, maintaining a designated finished card size. What is also needed is an item which will allow an infinite variety of options in terms of the material being printed upon any of the sides of the multiple sheets of the item.

Clearly, it is desirable for an item of this type to be very adaptable. At the same time, the item should be easy to manufacture and be produced of cost effective material. It is the object of this invention to set forth a multiple layered card assembly which avoid the disadvantages, previously mentioned limitations of typical current card products.

SUMMARY OF THE INVENTION

Particularly, it is the object of this invention to teach a multiple layered card assembly, for use in advertising and promotional activities, said structure comprising a multiple layered card comprising a top sheet of material having a front side and a rear side, said front side and said rear side having printable areas for providing a destination of the card return address and a promotional message respectively; a bottom sheet of material adhered to at least a portion of the rear side of said front sheet of material; said bottom sheet of material having a front side and rear side having printable areas and the front side of said bottom sheet of material having an adhesive coating adhered thereto, the front side of said bottom sheet of material being removably attachable to the rear side of the top sheet of material; wherein said bottom sheet of material is removable from said rear side of said top sheet of material and areas of said bottom sheet of material are attachable to other areas of said bottom sheet of material so that specific information can be returned to the card senders. Also it is the object of this invention to teach a multiple layered card assembly, for use in advertising and promotional activities, said structure comprising in combination a multiple layered card comprising at least a primary sheet of material and a secondary sheet of material being adhered together, said primary sheet of material and said secondary sheet of material having a front side and a rear side; said primary sheet of material and said secondary sheet of material having printable areas thereon; at least one side of said sheets of material having areas of adhesive coating thereon and at least one side of said sheets of material having areas of release materials coated thereon; wherein areas of one of said sheets of materials being replaceably connected with areas of the other sheet of material.

It is also the object of this invention to teach a method of producing a multiple layered card assembly, for use in advertising and promotional activities, said method comprising the steps of providing at least one sheet of material, each of said sheets having a front side and a rear side; printing said sheets of material on any of the sides as necessary for the specific item; applying at least one coating of release agent on said sheets of material; applying at least one adhesive layer as desired on said sheets of material for joining said sheets together; laminating of the sheets together; and installing a separation mechanism for increasing the ease of separation of said sheets of material.

BRIEF DESCRIPTION OF THE INVENTION

Further objects and features of this invention will become more apparent by reference to the following description taken in conjunction with the following figures, in which.

DESCRIPTION OF THE PREFERRED EMBODIMENTS

Figure 1:
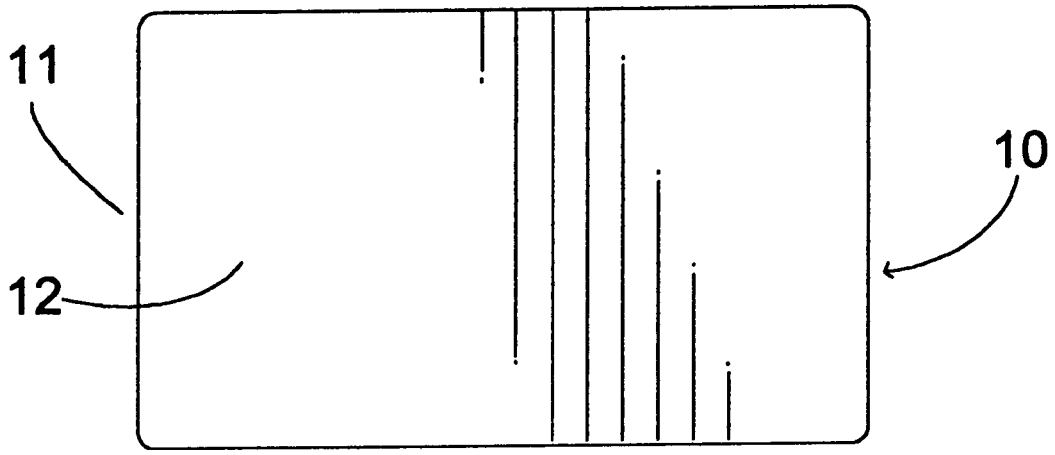
FIG. 1 is a front elevational view of the front side of the primary sheet of the multiple layered cards.
Figure 2:
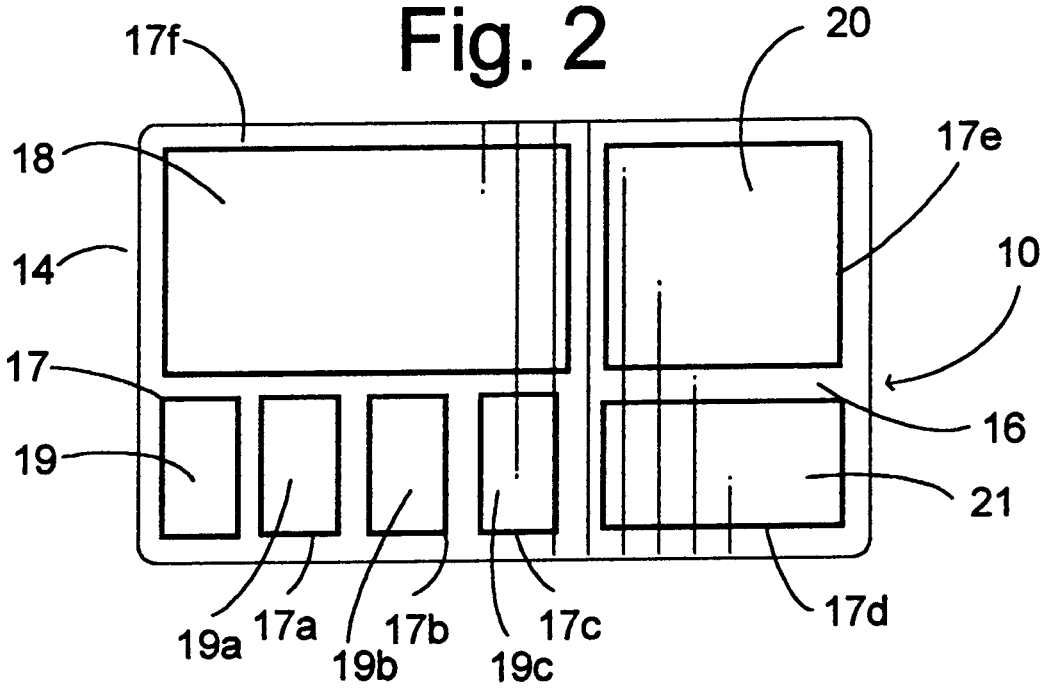
FIG. 2 is a rear elevational view of the rear side of the secondary sheet of the multiple layered cards.

As shown in the figures, the novel multiple layered card assembly 10 comprises a top sheet 11 having a front side 12 and a rear side 13. The front side 12 and the rear side 13 have a plurality of printable areas upon which addresses, promotional messages, instructions, specific and variable numbers and the like may be printed. A bottom sheet 14 is provided having a front side 15 and a rear side 16 upon which there are a plurality of printable areas that return post cards, phone cards, calendars, personalized information or the like can be printed thereon depending on what the specific requirements of the particular card happen to be. It is also possible to print specific variable information to be printed on any side of the multiple sheets of the card. The rear side 13 of the top sheet 11 has a layer of adhesives applied in a predetermined pattern depending upon the specific requirements of the particular card.

Figure 8:
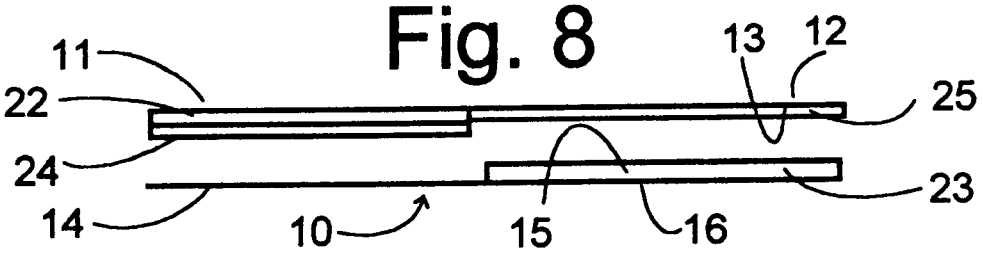
FIG. 8 is a cross sectional view of the preferred embodiment of the construction of the multiple layered card assembly.
Figure 3:
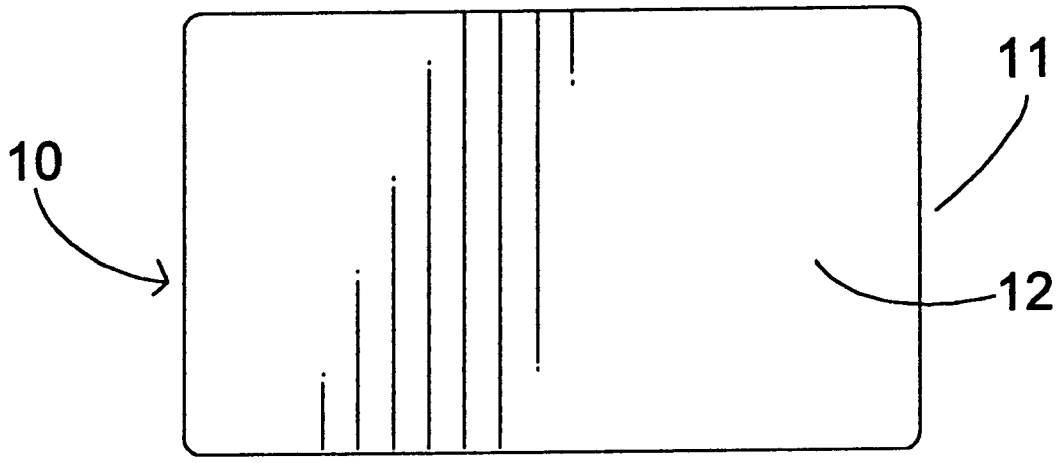
FIG. 3 is rear elevational view of the rear side of the primary sheet of the multiple layered cards.
Figure 4:
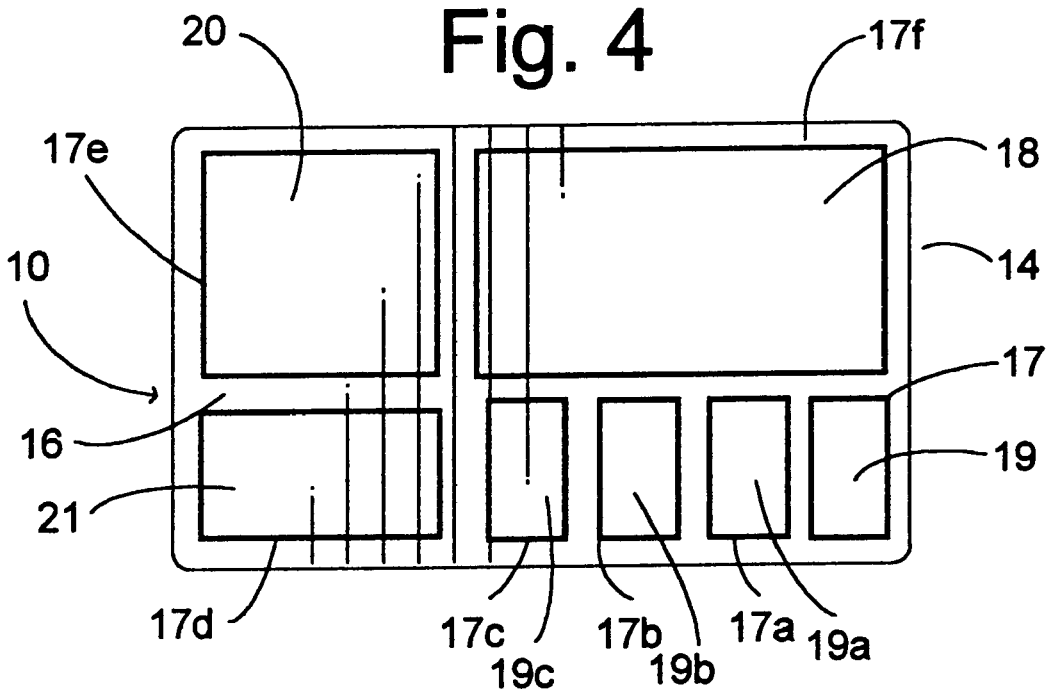
FIG. 4 is a front elevational view of the front side of secondary sheet of the multiple layered cards.
Figure 9:
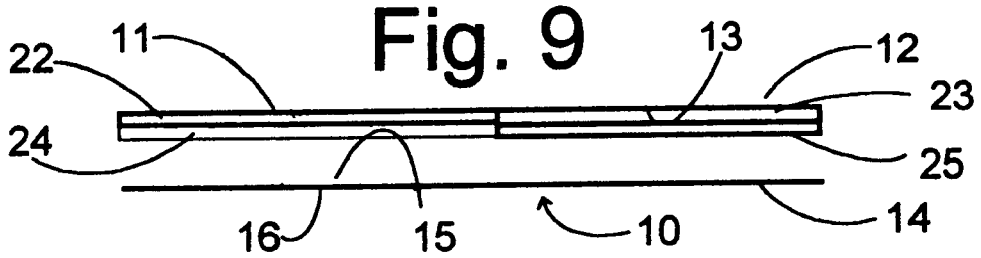
FIG. 9 is a cross sectional view of an alternate embodiment thereof.
Figure 5:
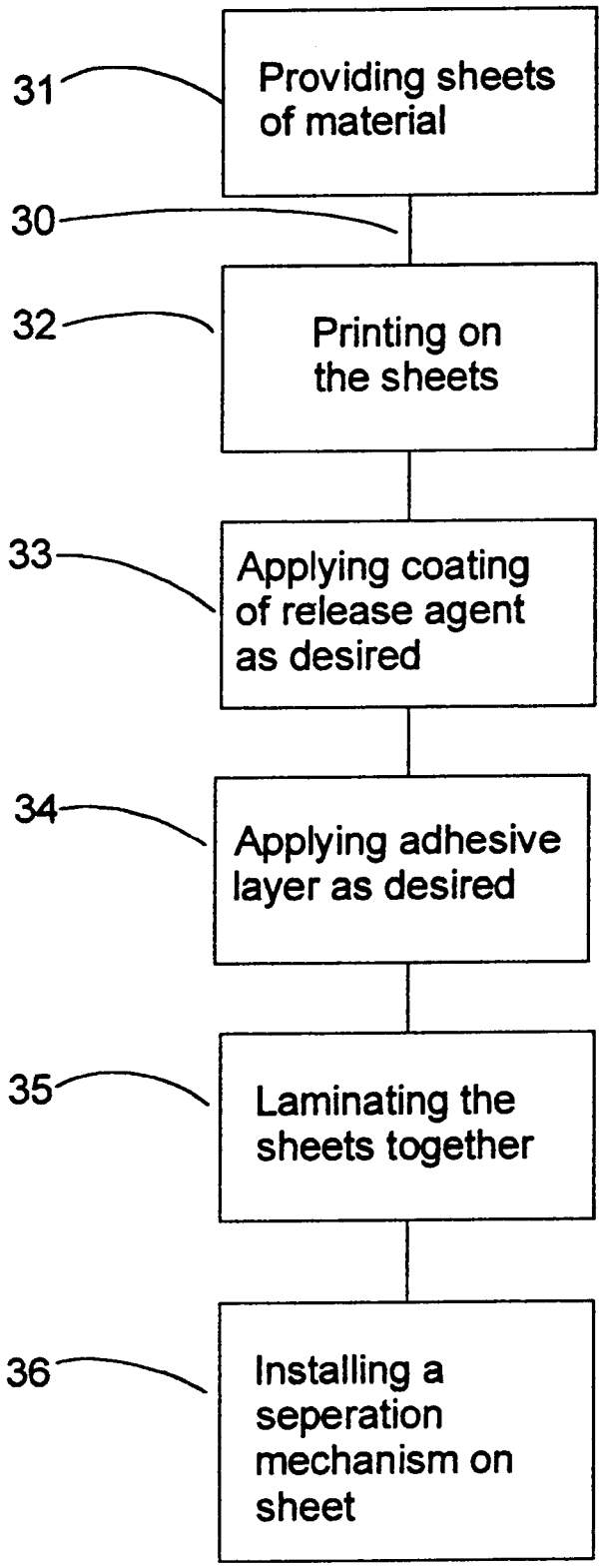
FIG. 5 is a block diagram showing the novel method of producing the multiple layered cards.
Figure 6:
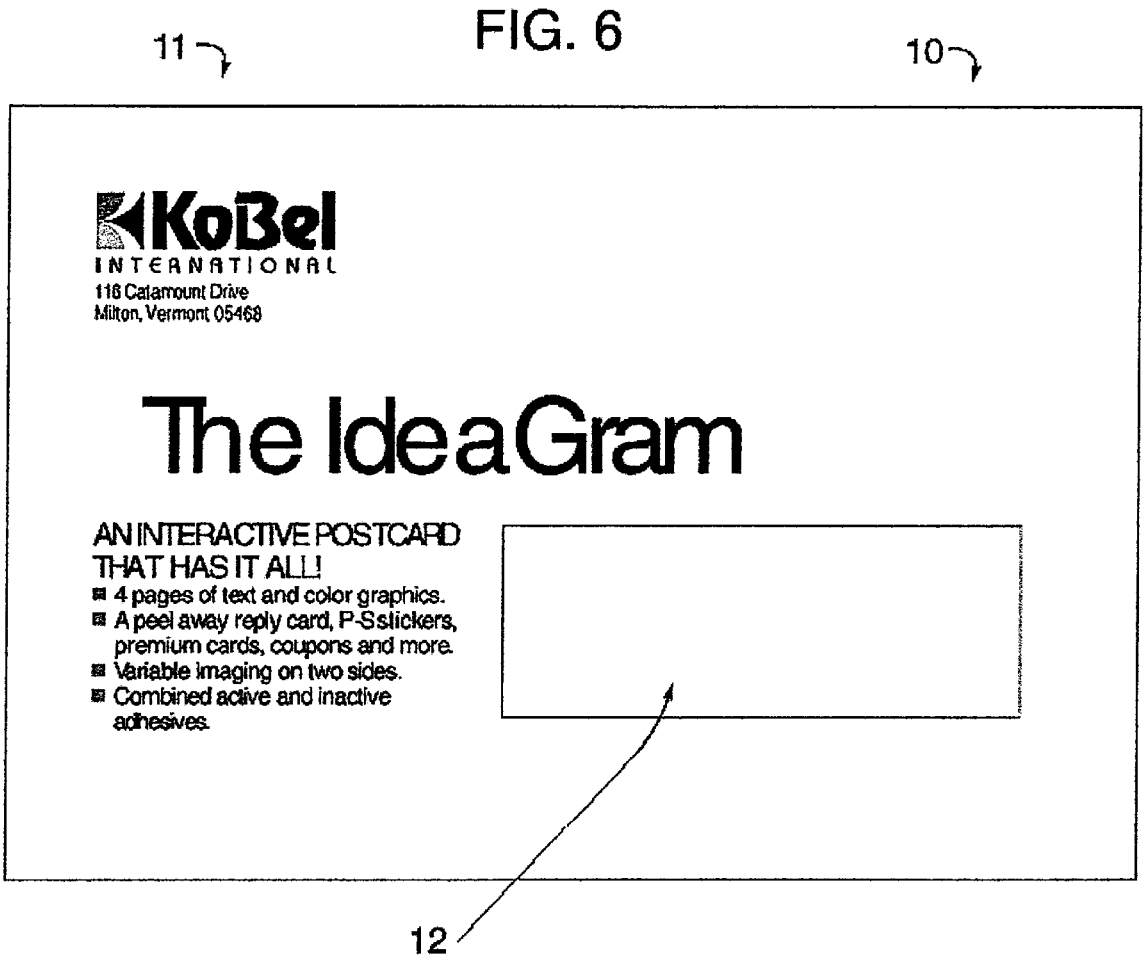
FIG. 6 is a top plan view of the finished multiple layered card assembly.
Figure 7:
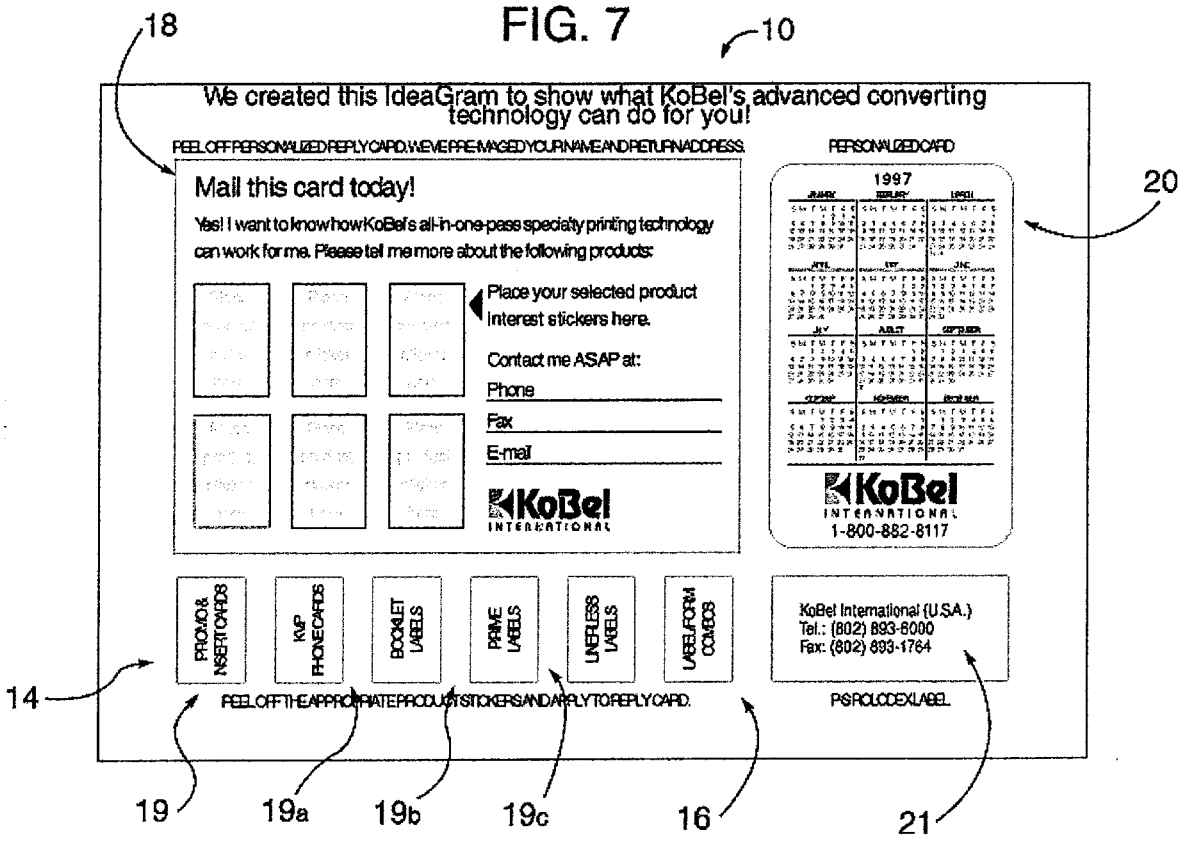
FIG. 7 is a bottom plan view thereof.

A plurality of release agents such as a coating of silicone 22 or dry strippable varnish 23 would be applied in predetermined areas. In the preferred embodiment shown in FIG. 8, the varnish coating 23 is positioned on the front side 15 of the bottom sheet 14 with the dry strippable adhesive 25 being opposite on the rear side 13 of the top sheet 11. The silicone layer 22 will be positioned on the rear side 13 of the top sheet 11 with the pressure sensitive adhesive 24 positioned on top of it. The pattern used with the release agent will be matched up with the adhesive patterns to facilitate the separation of the card 10. In cases that do not require total separation, the release agent application would be limited to those areas where opening is desired, not the whole card. The multiple sheets 11 and 14 are then laminated together. The pattern of adhesive is layered on top of the release agent during the manufacture of the product and the lamination process transfers the adhesive onto the proper position from the top sheet to the bottom sheet. A separation mechanism comprises using die cuts 17, 17*a*, 17*b*, 17*c*, 17*d*, 17*e* and 17*f* on the bottom sheet to create a return post card 18, stickers 19, 19*a*, 19*b*, and 19*c* showing customer preferences or interests. The stickers can be attached to the return post card 18. Also, a calendar 20 and phone list attachment 21 are shown. Other objects such as phone cards or the like can be prepared. In one of a number of alternate embodiments, as shown in FIG. 9, the varnish coating 23 is positioned on the rear side 13 of the top sheet 11 with the dry strippable adhesive 25 over it. Obviously, reversing positions of the adhesives and the release agents in other alternate embodiments is clearly to be part of this invention as long as such positioning results in the described finished product.

The novel method 30 of producing a multiple layered card assembly comprises the following steps: providing at least one sheet of material having a front side and a rear side 31; printing said sheets of material on any of the sides as necessary for the specific item 32; applying at least one coating of a release agent on the sheets of material 33; applying at least one adhesive layer as desired on said sheets of material for joining said sheets together 34—if a single sheet of material is used the material is crossed over prior to the adhesive being applied; laminating said sheets together 35; and installing a separation mechanism for increasing said ease of separation of said sheets of material 36.

The release agent and the adhesive can be applied in a manner that will determine those areas of the card that the manufacturer wishes to have separated by the consumer. The varnish coating is applied to the front side of the bottom sheet and the silicone is applied to the rear side of the top sheet or in the reversed fashion. The adhesives are applied over the top of the silicone layer and on the balance of the rear side of the top sheet and are selectively transferred to the front side of bottom sheet of material or in a reversed manner as described under alternate embodiments. This design creates a variable number of combinations of adhesive qualities for the multiple layered card assembly—the dry strippable card for the post card and the attachable stickers and the permanently attached border. The multiple layers of material can be produced from two separate webs of material or can be produced from a single web that is slit and crossed over onto itself during the process of manufacturing. The flexibility provided to the manufacturer afforded by this process allows an infinite number of formats of cards to be produced to meet the demands of the clients.

While I have described my invention in connection with specific embodiments thereof, it is clearly to be understood that this is done only by way of example and not as a limitation to the scope of my invention as set forth in the objects thereof and in the appended claims.

I claim:

1. Multiple layered card assembly, for use in advertising and promotional activities, said structure comprising:

a multiple layered card comprising a top sheet of material having a front side and a rear side, the front side and the rear side having printable areas for providing information;

a bottom sheet of material adhered to at least a portion of the rear side of said top sheet;

said top sheet of material having a layer of silicone positioned on said rear side of said top sheet;

said top sheet of material further having a layer of adhesive positioned over said silicone for permitting the attaching of said bottom sheet of material to said top sheet of material as said adhesive is transferred to said front side of said bottom sheet during manufacture;

said bottom sheet having a front side and a rear side, the front side and the rear side having printable areas and the front side of the bottom sheet of material having an adhesive coating adhered thereto, the front side of said bottom sheet of material being removably attachable to the rear side of the top sheet of material;

said bottom sheet of material having a coating of a pattern of dry strippable varnish on said front side of said bottom sheet of material positioned thereon as desired for permitting ease of removal of said bottom sheet from said top sheet;

wherein said bottom sheet of material is removable from said rear side of said top sheet of material and areas of said bottom sheet of material can be reattached to other areas of said bottom sheet of material so that specific information can be returned to those initiating the promotional or advertising activities.

2. A multiple layered card assembly, according to claim 1, wherein:

said adhesive coating on said multiple layered card assembly comprises the use of a combination of adhesives and release agents for permitting removal of certain areas of said bottom sheet of material for being attached to said top sheet of material, allowing reattachment of previously removed areas of said bottom sheet of material to other areas of said bottom sheet of material, and for permanently attaching certain areas of said bottom sheet of material from said top sheet of material.

3. A multiple layered card assembly, according to claim 1, wherein:

said multiple layered card assembly comprises a top sheet of material and a bottom sheet of material being laminated together; and said lamination of said top sheet of material and said bottom sheet of material comprises pressing said sheets together for a single entity and transferring said adhesive layer from said top sheet of material to said bottom sheet of material.

4. A multiple layered card assembly, according to claim 1, wherein:

said multiple layered card assembly comprising an assembly having a separation mechanism thereon; and said separation mechanism comprises die cutting said bottom sheet of material as desired to create return mail cards, specific information return requests, phone cards, calendars and similar items.

5. A multiple layered card assembly, for use in advertising and promotional activities, said structure comprising in combination:

a multiple layered card comprising at least a primary sheet of material and a secondary sheet of material being adhered together, said primary sheet of material and said secondary sheet of material having a front side and a rear side;

said primary sheet of material and said secondary sheet of material having printable areas thereon;

at least one side of said sheets of material having areas of adhesive coating thereon and at least one side of said sheets of material having areas of release material coated thereon;

said areas of release materials comprising a combination of areas of silicone coating and some areas of dry strippable varnish for facilitating areas for ease of removal;

wherein areas of one of said sheets of material being replaceably connected with areas of the other sheet of material.

* * * * *